US005865410A

United States Patent [19]

Horen

[11] Patent Number: 5,865,410

[45] Date of Patent: Feb. 2, 1999

[54] UNIVERSAL STAGING BRACKET

[75] Inventor: David J. Horen, Virginia Beach, Va.

[73] Assignee: Metal Products Specialists, Inc., Virginia Beach, Va.

[21] Appl. No.: 617,214

[22] Filed: Mar. 18, 1996

[51] Int. Cl.[6] ..... E04G 3/00; A47G 29/02

[52] U.S. Cl. ..... 248/242; 248/240.4; 182/82

[58] Field of Search ..... 182/223, 45, 188, 182/82, 186.9, 206; 248/242, 240.4, 284.1; 108/106, 107, 108, 134, 152; 211/88.01, 90.01, 90.02, 96, 150, 168

[56] References Cited

U.S. PATENT DOCUMENTS

| | | | |
|---|---|---|---|
| 840,773 | 1/1907 | Kent | 248/242 X |
| 2,173,569 | 9/1939 | Troendle | 108/134 |
| 2,195,579 | 4/1940 | Murdock | 248/242 |
| 2,446,093 | 7/1948 | Lambert | 182/45 X |
| 2,693,400 | 11/1954 | Erickson | 108/134 |
| 2,898,071 | 8/1959 | Williams | 248/242 |
| 2,916,245 | 12/1959 | Williams | 248/242 |
| 3,134,567 | 5/1964 | Shoemaker | 182/82 |
| 3,776,498 | 12/1973 | Peters et al. | 248/242 X |
| 4,382,571 | 5/1983 | Horen | 248/235 |
| 4,660,800 | 4/1987 | Horstketter | 14/71.3 X |
| 5,067,586 | 11/1991 | Myers | 182/45 |
| 5,318,148 | 6/1994 | Franco et al. | 182/45 |

FOREIGN PATENT DOCUMENTS

| | | | |
|---|---|---|---|
| 0 318 373 | 5/1989 | France | 182/45 |
| 4034229 | 4/1992 | Germany | 182/45 |
| 1516915 | 7/1978 | United Kingdom | 182/82 |

*Primary Examiner*—Leslie A. Braun
*Assistant Examiner*—Stephen S. Wentsler
*Attorney, Agent, or Firm*—Sughrue, Mion, Zinn, MacPeak & Seas, PLLC

[57] ABSTRACT

A universal staging bracket is supported on the sloping side of a steel ship or the like by means of a base plate having key hole apertures which engage headed studs welded to the side of the ship. A support arm is pivotally mounted on the base plate for disposition in a horizontal position when the base plate is not vertically disposed. A support leg is pivotally mounted on the base plate for pivotal movement to accommodate complex curvatures in the side of the ship and a telescopic knee brace is pivotally connected at opposite ends between the support leg and the support arm. The pivotal connection between the support arm and the knee brace includes a travelling nut on a threaded bolt rotatably supported by the support arm

3 Claims, 4 Drawing Sheets

UNIVERSAL STAGING BRACKET

BACKGROUND OF THE INVENTION

The present invention is directed to a universal staging bracket for supporting a platform on the sloping sides of a ship or other irregular surface. The staging bracket is adjustable in increments so that the platform may be maintained horizontal relative to a vertical axis of the ship.

The most common method of staging large steel structures is with the use of "free standing" staging. This staging is of the tubular type generally seen at building construction sites. There are many different types, but the concept is similar and each consists of many different components that are fitted together in a series of boxes or towers. The staging is erected from the ground up. The main disadvantages are the excessive amount of time required to erect the structure, the number of different components to purchase and keep track of and the amount of valuable work area utilized at the base of the structure being staged. To overcome these disadvantages, attempts have been made to utilize scaffold brackets which are mounted on the side of the structure being worked upon.

The prior U.S. patent to Horen (U.S. Pat. No. 4,382,571) discloses the basic concept of an adjustable scaffold bracket wherein a support plate is provided with a pair of key hole slots adapted to be fitted over headed studs welded to the side of a ship to support the plate on the side of the ship. A support beam can then be adjustably mounted on the support plate at different angles relative thereto so that the support beam can be maintained horizontal when the support plate is secured to the sloping side of a ship or the like.

The U.S. Patent to Williams (U.S. Pat. No. 2,916,245) also discloses an adjustable scaffold bracket comprised of a vertical support member having a horizontally disposed support member pivotally mounted at the upper end of the vertical bracket. A diagonal brace is pivotally connected at opposite ends to the vertical and horizontal supports and is comprised of a pair of telescoping members. The vertical member may be supported on a sloping surface and the horizontal member pivoted relative thereto to maintain a scaffold supported thereby in the horizontal position.

The U.S. Patent to Horstketter (U.S. Pat. No. 4,660,800) is directed to a bridge overhang bracket and hanger comprised of a horizontally disposed support member and a telescopic diagonal support member adjustably secured to the underside of the horizontal support member by means of a bracket threadedly engaged with a horizontal bolt rotatably supported on the undersurface of the horizontal member. The angle of the horizontal member can be initially adjusted by means of the telescopic diagonal compression member and finally adjusted by means of the bolt and travelling bracket assembly.

SUMMARY OF THE INVENTION

The present invention provides a new and improved adjustable scaffold bracket for use with steel plate fabrication which may be readily adjusted to the angle of the steel plate so as to provide a horizontal work platform.

The present invention provides a new and improved staging bracket comprised of a flat base plate having attachment means for detachably supporting said base plate on a sloping support surface, a support arm pivotally mounted on said base plate for supporting staging boards in a substantially horizontal position, a downwardly depending support leg pivotally mounted on said base plate and telescopic knee brace means pivotally connected between said support leg and said support arm to provide support for a load on said support arm.

The telescopic knee brace is provided with means for locking the knee brace in a plurality of adjustable length positions and a rotatable threaded bolt and travelling nut assembly is mounted on an underside of said support arm with one end of the telescopic knee brace means being pivotally connected to the travelling nut to provide a fine adjustment with respect to the pivoted connection.

The above and other objects, features and advantages of the present invention will be more apparent and more readily appreciated from the following detailed description of preferred exemplary embodiment of the present invention, taken in connection with the accompanying drawings.

DETAILED DESCRIPTION OF THE INVENTION

Figure 2:
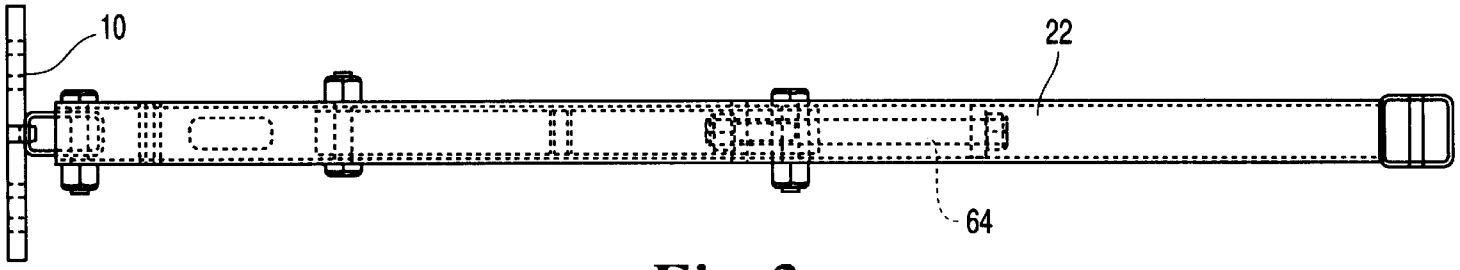
FIG. 2 is a top plan view thereof.

The staging bracket according to a first embodiment of the present invention is shown in FIGS. 1–5 inclusive. A flat rectilinear steel base plate 10 is provided with 2 spaced apart key hole slots 12 and 14. A pair of headed studs (not shown) are welded to a steel plate or the like, which could be part of the side of a ship, which would have variable sloping contours in the vertical direction. The key hole slots 12 and 14 would be placed over the headed studs and the base plate 10 lowered to secure the studs in the narrow ends of the key hole slots. In order to secure the base plate 10 against the side of the ship to prevent lifting of the base plate from the studs, a set screw 16 is threaded through an aperture in the base plate 10 for engagement with the side of the steel plate which comprises the side of the ship. A tubular steel support tube 18 is welded to the face of the base plate 10 and a small spacer rod or bar 20 is welded to the lower end of the support leg 18 on the same side as the base plate 10 to support the lower end of the support leg 18 against the side of the ship.

A generally horizontally disposed support arm 22, which is also of tubular steel construction, is pivotally mounted on the upper end of the support leg 18 by means of a bolt 24 extending through aligned apertures in the support leg 18 and the support arm 22. The lower surface of the tubular support arm 22 is cut away adjacent the pivoted connection to prevent interference of one tubular member with the other during pivotal movement. For the same reason, the upper surface 28 of the support arm 22 is spaced above the upper end 30 of the support leg 18 to prevent interference during pivotal movement in the upward direction. Thus, the support arm 22 can be pivoted upwardly relative to a line perpendicular to the base plate 10 by an angle A which is a maximum of 25°. The support arm 22 can be pivoted downwardly with respect to the same line by an angle B, the maximum of which is 50°. Thus, if the base plate 10 is mounted on a sloping surface which is not vertical, the support arm 22 can be pivoted into a horizontal position to support staging boards (not shown) thereon, thereby providing a horizontal work platform. A hollow tubular steel socket 32 is welded at right angles to the outermost end of the support arm 22 for receiving a stanchion or the like. The stanchion (not shown) is supported within the tubular member by a crossbar 34 which is welded across the bottom end of the tubular socket 32 and a through hole 36 is provided for the reception of a securing pin or the like.

In order to support the support arm 22 in the horizontal position, a telescopic knee brace 40 is pivotally connected between the support leg 18 and the support arm 22. The lower larger diameter steel tube 42 is pivoted at one end to the lower end of the support leg 18 by means of a nut and bolt assembly 44. A smaller diameter steel tube 46 is slidably mounted within the larger diameter steel tube 42 and is pivotally connected at the upper end thereof to a travelling nut 48 by means of a nut and bolt assembly 50. The steel tube 42 is provided with three transverse apertures 54, 56 and 58 and the steel tube 46 is provided with a single transverse aperture 60 at the end thereof opposite the nut and bolt assembly 50. The aperture 60 may be aligned with any one of the three apertures in the steel tube 42 and a nut and bolt assembly 62 may be secured therethrough to lock the steel tubes 42 and 46 in any one of three adjusted positions.

Figure 5:
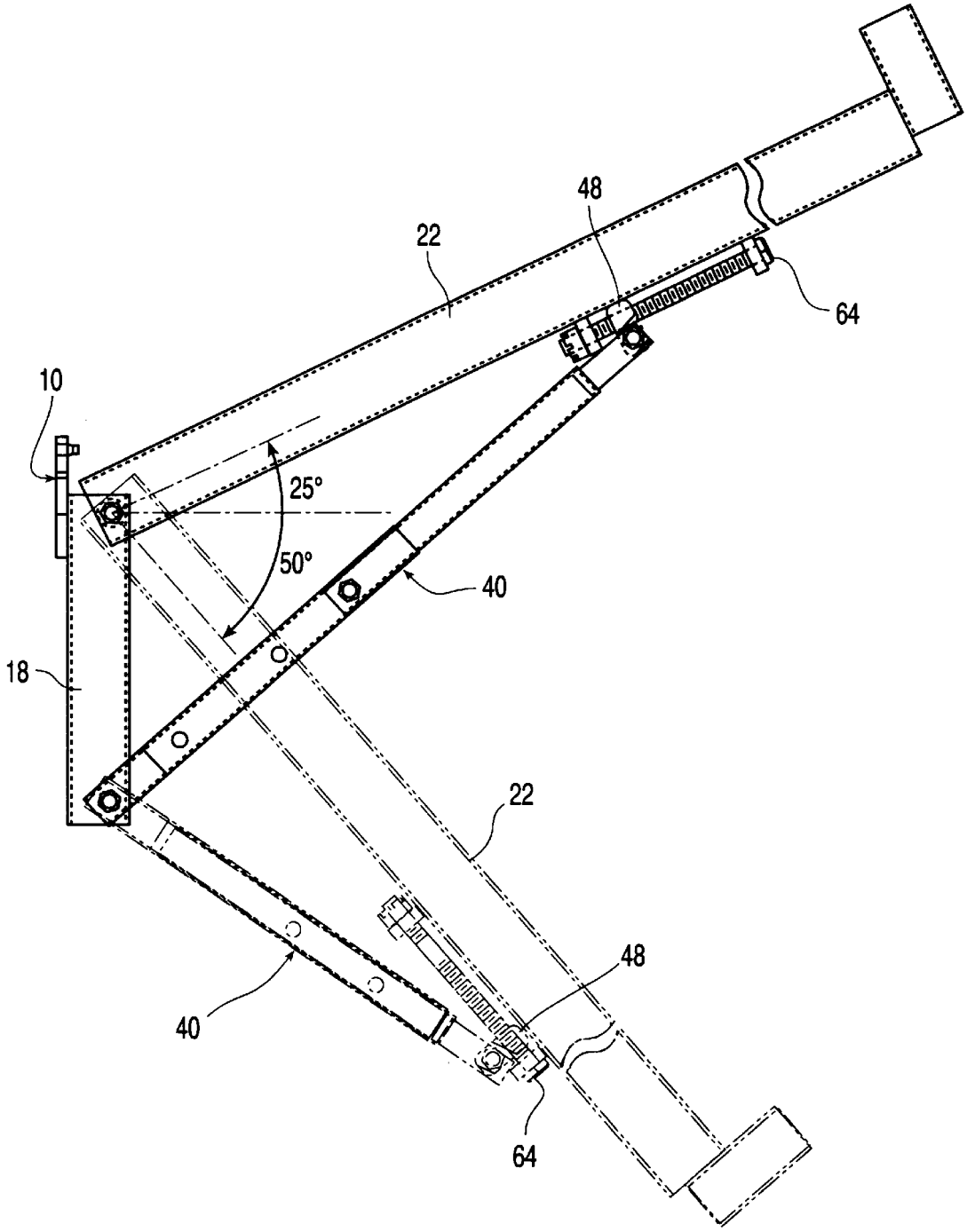
FIG. 5 is a side elevation view similar to FIG. 1 showing the support arm pivoted to the maximum and minimum elevations, respectively.

An elongated threaded bolt 64 is supported on the undersurface of the tubular support arm 22 by means of a pair of support brackets 66 and 68 and the travelling nut 48 is threaded thereon for movement along the length of the bolt upon rotation of the bolt 64. Thus, the initial adjustment of the angle between the support arm 22 and the support leg 18 is accomplished by adjusting the telescopic setting of the knee brace 40. The fine adjustment of the angular setting is accomplished by rotating the bolt 64 to move the travelling nut 48 in one direction or the other. The maximum and minimum angles between the support arm 22 and the support leg 18 are shown in FIG. 5. In the maximum elevated position of the support arm 22, the telescopic adjustment is at its maximum and the travelling nut 48 is moved to the extreme left of the threaded bolt 64. At the minimum elevation, the telescopic knee brace 40 is adjusted to its shortest length and the travelling nut 48 is moved to the extreme right of the threaded bolt 64.

Figure 1:
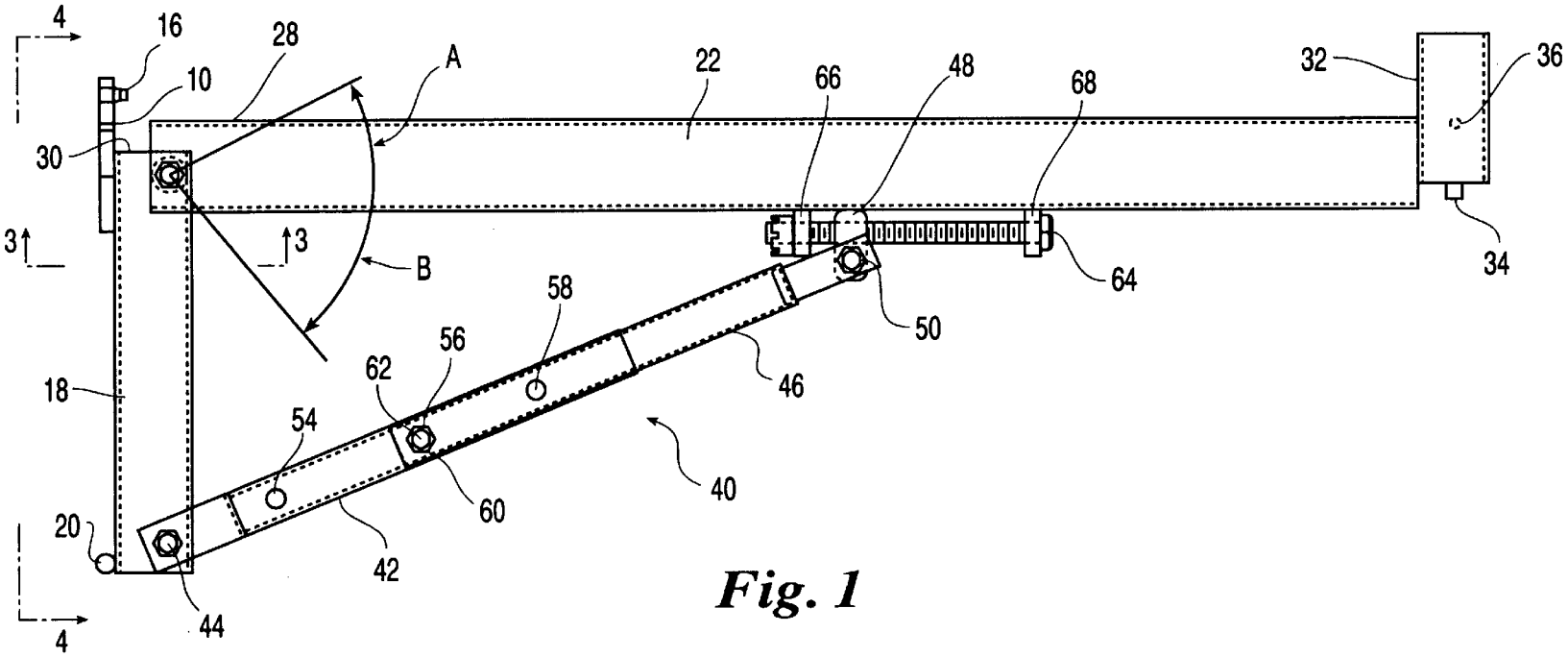
FIG. 1 is a side elevational view of a universal staging bracket according to a first embodiment of the present invention.
Figure 6:
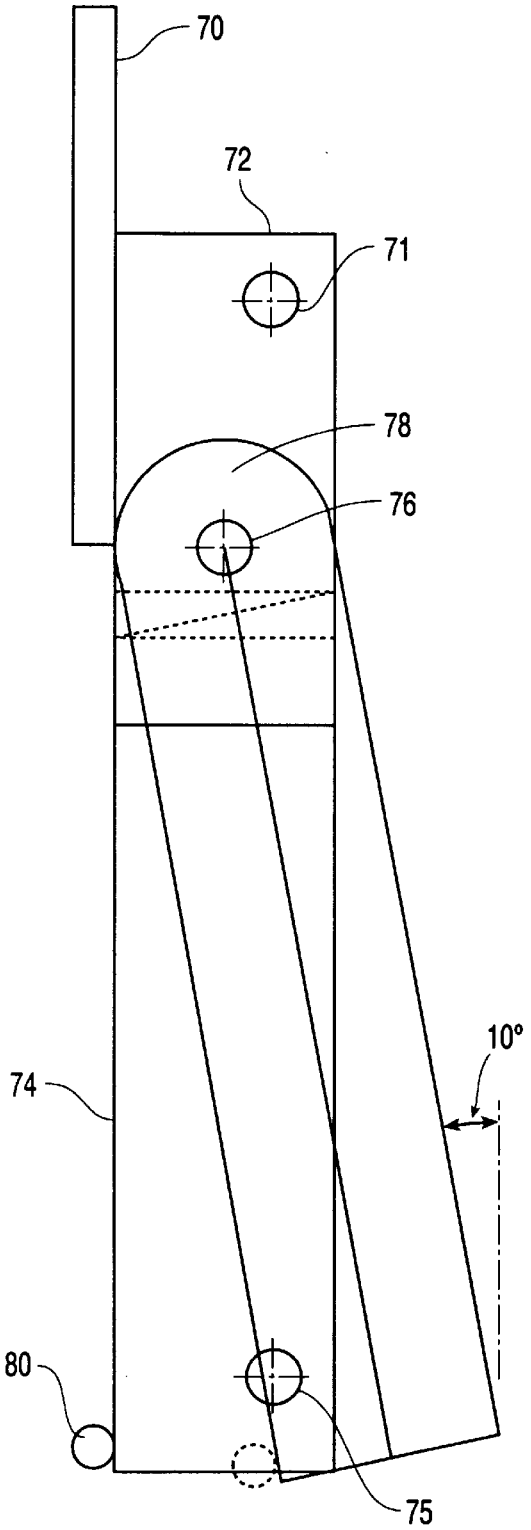
FIG. 6 is a side elevation view of the base plate and depending support leg according to a second embodiment of the present invention.
Figure 3:
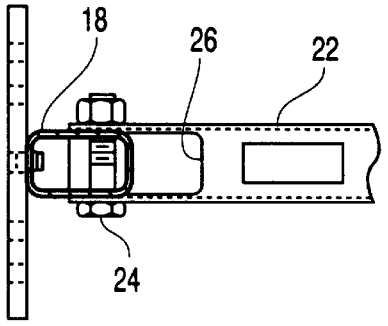
FIG. 3 is a sectional view taken along the line 3—3 in FIG. 1.
Figure 4:
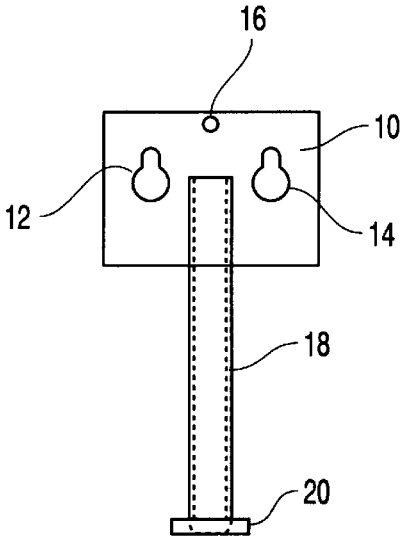
FIG. 4 is an end elevation view of the base plate and depending support leg taken in the direction of the arrows 4—4 in FIG. 1.
Figure 7:
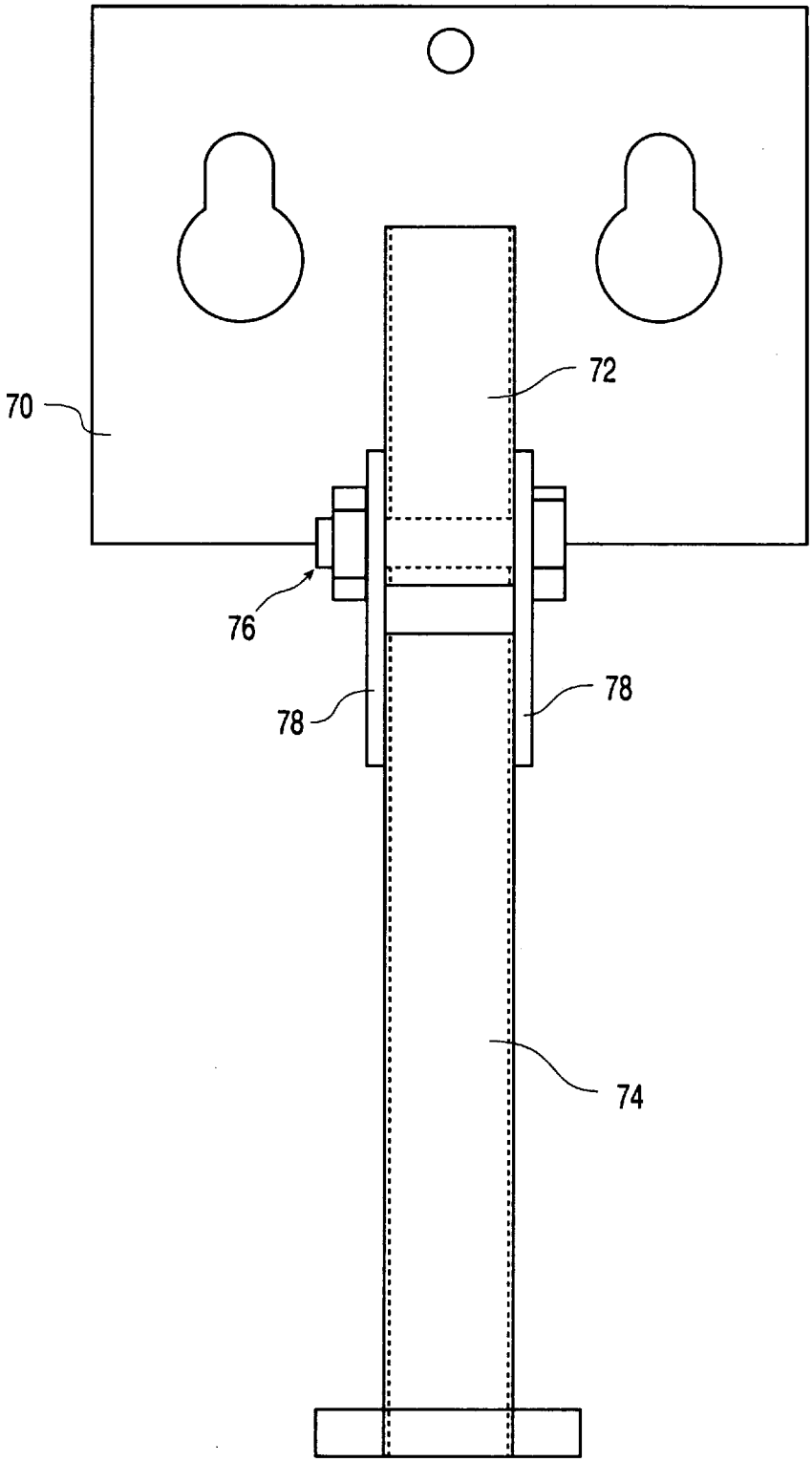
FIG. 7 is a front elevational view of the base plate and depending support leg shown in FIG. 6.

In a modification of the present invention as shown in FIGS. 6 and 7, the base plate 70 which is substantially identical to the base plate 10, is provided with a short hollow pipe 72 having a rectangular cross-section which is welded on the face of the base plate 70. A pair of plates 78 are welded to opposite sides of a hollow tubular support leg 74 having a rectangular cross-section. A nut and bolt assembly 76 extends through aligned apertures in the plates 78 and the pipe 72 to pivotally mount the support leg 74 on the pipe 72 and the base plate 70. The upper ends of the plates 78 are rounded to allow the pivotal action without interference with the base plate 70. A transverse rod or bar 80 is welded to the lower end of the support leg 74 as in the previous embodiment for the same purpose. The support arm 22 may be pivoted to the pipe 72 by a nut and bolt assembly through apertures 71 as shown in FIG. 3 of the first embodiment. The knee brace 40 may be pivotally connected to the support leg 74 at aperture 75 in the same manner in which the knee brace 40 is pivotally connected to support leg 18 at 44 as shown in FIG. 1.

By having the support leg 74 pivotally mounted with respect to the base plate 70 for pivotal movement up to 10° from the vertical, it is possible to mount the base plate 70 and the support leg 74 on the side of a ship having a more complex curvature. When the support leg in welded to the base plate as in the first embodiment, the support surface must be flat for the combined length of the base plate and support leg. Thus, the pivotal connection allows for increased versatility when utilizing the staging bracket of the present invention.

While all of the components of the present invention are preferably formed from steel, it is possible to utilize other high strength composites or plastics in lieu of steel. While a telescopic connection for the knee brace is preferred, it is possible to utilize other longitudinal types of adjustment for varying the length of the knee brace. Likewise the details of the travelling nut and bolt assembly may be varied for achieving the fine adjustment of the angular disposition of the support leg and the support arm.

While the invention has been particularly shown and described with reference to preferred embodiments thereof, it will be understood by those in the art that the foregoing and other changes in form and details may be made therein without departing from the spirit and scope of the invention.

What is claimed is:

1. A staging bracket for supporting a horizontally disposed staging board on a sloping support surface comprising a flat base plate having attachment means for detachably supporting said base late on the sloping support surface, a support arm pivotally mounted on said base plate for supporting a staging board in a substantially horizontal position, a downwardly depending support leg pivotally mounted on said base plate and adjustable knee brace means pivotally connected between said support leg and said support arm to provide support for a load on said support arm, wherein said adiustable knee brace means is comprised of a pair of telescopic tubular steel members having transversely extending apertures therein and connecting means for extending through aligned apertures to secure said telescopic members in adjustable length positions.

2. A staging bracket as set forth in claim 1, further comprising threaded bolt means rotatably supported on said support arm, a travelling nut movable along said threaded bolt upon rotation of said bolt and connecting means pivotally interconnecting one end of said knee brace means to said travelling nut.

3. A staging bracket as set forth in claim 1, wherein said support arm is pivotable upwardly relative to a line perpendicular to said base plate and downwardly with respect to said line to maintain said support arm horizontal when said base plate is mounted on said sloping support surface and disposed at an angle on either side of a vertical plane.

* * * * *